US005181366A

United States Patent [19]

Smith et al.

[11] Patent Number: 5,181,366

[45] Date of Patent: Jan. 26, 1993

[54] CRIMPER-PROPELLANT FILL HEAD

[75] Inventors: Rodney P. Smith; Gregory C. Vens, both of Moline, Ill.

[73] Assignee: The Kartridg Pak Co., Davenport, Iowa

[21] Appl. No.: 788,096

[22] Filed: Nov. 5, 1991

[51] Int. Cl.[5] ..... B65B 3/04; B65B 31/04

[52] U.S. Cl. ..... 53/470; 53/88; 141/3; 141/11

[58] Field of Search ..... 141/3, 11, 20, 82; 53/470, 88, 86

[56] References Cited

U.S. PATENT DOCUMENTS

| | | | |
|---|---|---|---|
| 3,516,224 | 6/1970 | Caccini | 53/88 X |
| 4,588,000 | 5/1986 | Malin et al. | 53/88 X |
| 4,875,324 | 10/1989 | Cohrs | 53/88 |
| 4,938,000 | 7/1990 | Smith et al. | 53/88 |
| 4,999,976 | 3/1991 | Smith | 141/3 X |

*Primary Examiner*—James F. Coan

*Attorney, Agent, or Firm*—Lockwood, Alex, FitzGibbon & Cummings

[57] ABSTRACT

In the "undercap" method of, and closure cap crimper-propellant fill head apparatus for, introducing a charge of volatile propellant in its liquid state into an aerosol container containing product to be dispensed, a significant residual amount of the propellant charge remains in the crimper-propellant fill head bell after the closure cap has been secured in place to seal the container. Not all crimper-propellant head machines are equipped with systems for reclaiming residual propellant, and even when so equipped, it is not always practical to reclaim residual propellant since certain products to be dispensed will foul the reclamation equipment. According to this invention a compressed purge gas is injected into the crimper-propellant fill head bell to purge a substantial portion of the residual propellant into the container before it is sealed by crimping its closure cap on the container mouth. The efficiency of purging with compressed gases is enhanced by providing the crimper-propellant fill head bell with an annular groove on the interior communicating with the purging gas inlet together with a plurality of spaced axial grooves leading from the groove toward the bottom of the bell chamber. Another method of purging residual propellant is to have a sufficient temperature differential between the liquid propellant and the product and a sufficiently low pressure against which the cap can lift so that the residual propellant will be self-purging to a worthwhile extent.

6 Claims, 4 Drawing Sheets

CRIMPER-PROPELLANT FILL HEAD

BACKGROUND AND DESCRIPTION OF THE INVENTION

Figure 1A:
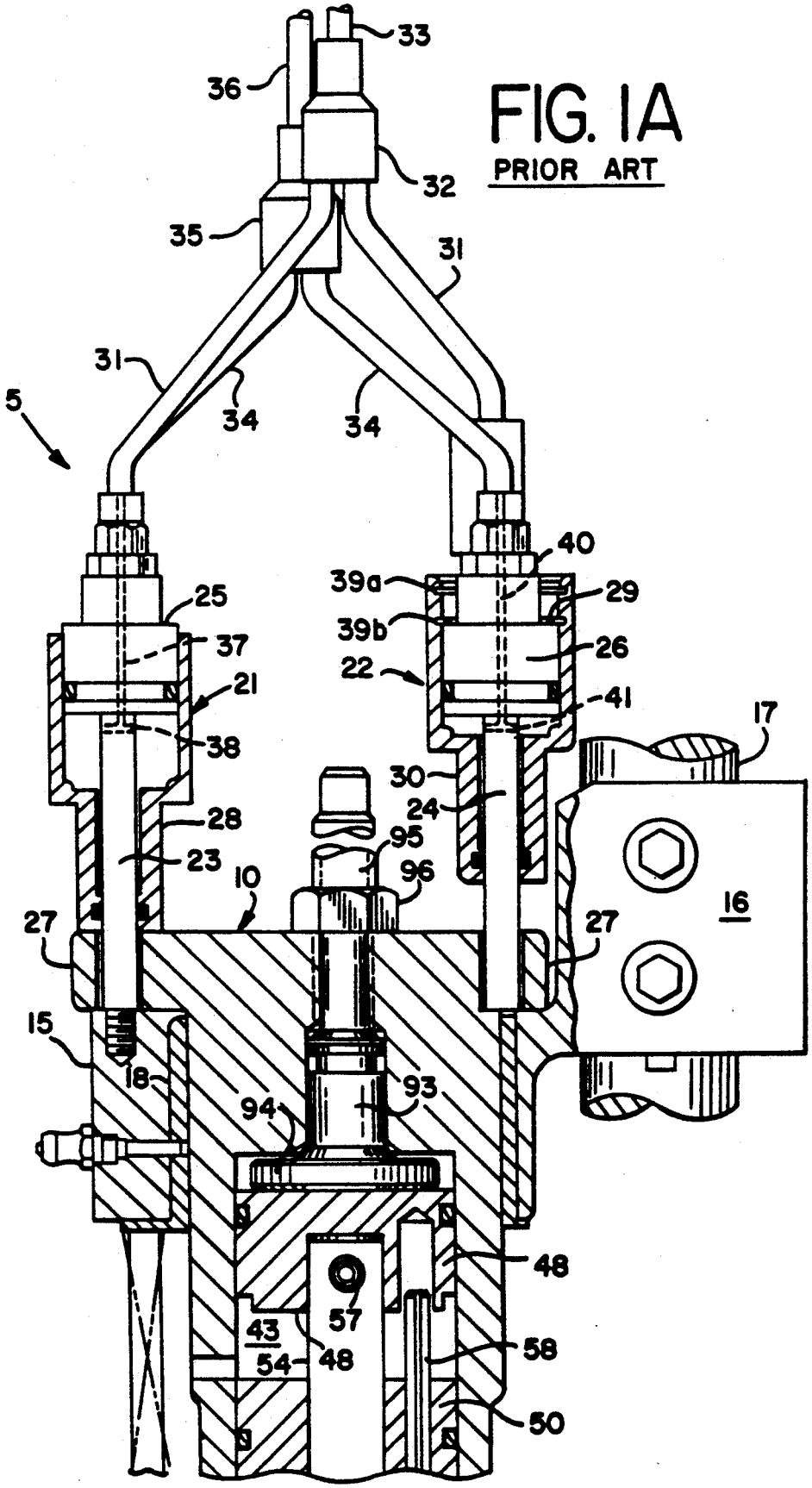
FIG. 1A PRIOR ART

This invention relates, generally, to innovations and improvements in the known "undercap" (also referred to as "undercup") method and apparatus for introducing volatile propellants in the liquid state into aerosol containers in which product to be dispensed has already been introduced. More particularly, the invention relates to improvements and innovations in the undercap method and apparatus whereby by use of purging techniques, the loss of residual liquid propellant may be substantially reduced. Further, the invention relates to a modification of the outer bell of an undercap crimper-propellant fill head whereby the efficiency of purging with a compressed gas is materially improved.

A wide variety of products have been long and widely available in aerosol packages or containers including such items as insecticides, paints, hair sprays, lubricants, flowable foods, etc. The art of filling aerosol containers with various products and introducing propellants thereinto is highly developed and high speed apparatus and equipment for performing the product and propellant filling operations is also highly developed and commercially available.

As is well known, after a product to be dispensed has been introduced into open aerosol containers, they are closed by means of closure caps on which are mounted dip tubes that extend down to adjacent the bottom interiors of the containers and manually operable, upwardly extending exterior dispensing valves. There are two general methods of charging the aerosol containers with volatile propellant which serves to dispense the product in spray or aerosol form through the exterior valves. One of the methods is the so-called "through the valve" method wherein the propellant is introduced through the exterior valve after the closure cap has been crimped or sealed to the mouth of the container. The second method is the so-called "undercap" method wherein the closure cap assembly is placed loosely on the mouth of a container filled with product and then a bell chamber is brought into sealing engagement with the top of the container including the closure cap and its assembled parts. The propellant charge is then introduced into the bell chamber so as to lift the closure cap and allow the propellant to flow into the mouth of the container. Thereafter, the closure cap is crimped into place. The present invention relates to the "undercap" method which is generally preferred for high speed/-high volume production lines.

A number of patents have issued on the so-called "crimping" or "crimper" heads used in commercially practicing the undercap method of charging aerosol containers with volatile propellants including the following: U.S. Pat. No. 3,157,974 dated Nov. 24, 1964; U.S. Pat. No. 4,875,324 dated Oct. 24, 1989 and U.S. Pat. No. 4,938,000 dated Jul. 3, 1990. The crimper-propellant fill heads disclosed in these patents have been commercially produced by the assignee thereof, namely, The Kartridg Pak Co. of Davenport, Iowa. Customers of The Kartridg Pak Co. have used these machines in the United States and a number of foreign countries to produce large quantities of aerosol packages. The disclosures of the three above patents are incorporated herein by reference and made a part hereof.

GENERAL OPERATION

The crimper-propellant fill heads shown and disclosed in the above-identified three patents as well as the commercial versions of these machines produced and sold by The Kartridg Pak Co. and used by their customers, all operate in generally the same manner. The production embodiments of these crimper-propellant fill heads have multiple heads ranging from up to twenty-four in number, depending on the production volume desired for a particular installation. The desired product is introduced into the open top mouths of the aerosol containers in a filling unit and the containers proceed to another unit in the production line where closure cap assemblies comprising closure caps having dip tubes and valves attached are placed loosely on the mouths of the containers. The containers then proceed to the crimper-propellant fill head unit wherein each aerosol container is brought into registration underneath one of the heads. Each head is cam-actuated and operates in accordance with a repetitive cycle so as to charge each aerosol container with volatile propellant and then crimp the loosely fitting closure cap into sealed relationship on the mouth of its particular container.

In the cycle of operation, the outer bell of a crimper-propellant fill head is lowered onto each container so as to form a hermetic seal therewith outwardly of the mouth of the container. Vacuum is applied to the bell chamber so as to remove residual air and any unwanted vapors from the head space in the container and from within the bell chamber. The vacuum causes the closure cap to lift so as to permit vacuumizing of the container head space. Next, the head operates to isolate the vacuum from the lower portion of the bell chamber and to introduce a predetermined charge of volatile propellant in liquid form into the bell chamber. Most, but not all, of the propellant charge will be forced underneath the lifted closure cap through the mouth of the container and into its head space. After the charge of propellant has been introduced, the crimper-propellant fill head operates to seat the closure cap onto the mouth of the container and then crimp it permanently in hermetically sealed relationship thereto. According to the present invention there is added to the above cycle of operation the new step of purging residual liquid propellant from the bell chamber into the container before the closure cap is crimped onto the container.

The crimper-propellant fill head shown and disclosed in U.S. Pat. No. 3,157,974 and embodied in commercial heads of The Kartridg Pak Co. relies on compression springs to lower certain components that have been lifted during the charging phase of the cycle. In the modified head, embodiments shown in U.S. Pat. Nos. 4,875,324 and 4,938,000, fluid pressure is utilized to lower or restore the working parts of the heads that were lifted during the propellant charging operation, instead of relying on compression springs. This modification not only substantially lowers the resistance that has to be overcome when the operating parts are lifted as the charge of propellant is introduced but also makes it possible to readily adjust the hydraulic or pneumatic force utilized to lower or reset the operating parts after charging has been completed and the crimping phase of the operating cycle is ready to take place.

Regardless of which of the forms of crimper-propellant fill heads disclosed in the three above patents and their commercial embodiments are used, an appreciable amount of residual liquid propellant will remain in the sealed bell chamber. The heads of some commercial undercap units have been equipped with propellant reclaim systems for removing and reclaiming the residual quantities of propellant from the bell chambers before these sealed chambers are opened to the atmosphere when the heads lift off from the aerosol containers at the end of the crimping head cycle of operation. However, certain products, such as paints, tend to contaminate or clog the reclaim systems to the extent that it is not practical to use them. In such instances where the reclamation systems are not used, or where a machine is not equipped with a reclamation system, when the cycle is completed the residual volume of liquid propellant boils into a gas and released into the atmosphere. The amount of liquid propellant that is trapped and lost to the atmosphere in this manner will be in the range of 2-3 milliliters per aerosol container. When it is taken into consideration that in one day of operation many thousands of aerosol containers are charged with propellant in a single production line, the cumulative loss of propellant is very significant.

The object of this invention, generally stated, is the provision of a method and means for significantly reducing this loss of residual propellant by as much as 50-66%, e.g. from a loss of 2-3 milliliters per container to a loss of on the order of 1 milliliter per container.

There are two techniques, according to this invention by which the loss of residual propellant can be reduced. One is by utilizing a compressed purging gas to force residual propellant into the head space of the container before the closure cap is crimped and sealed in place. The other technique is to rely on the residual liquid propellant itself to do the purging. This latter technique is effective when the product in the aerosol container is chilled and/or the liquid propellant is heated so that there is a substantial differential in vapor pressures whereby a portion of the residual propellant will vaporize quickly and force residual propellant into the head space of the container.

A further object of the invention is to modify the outer or lower bells of the crimper-propellant fill heads in such a way as to facilitate the action of compressed purging gases in performing their function.

Figure 1B:
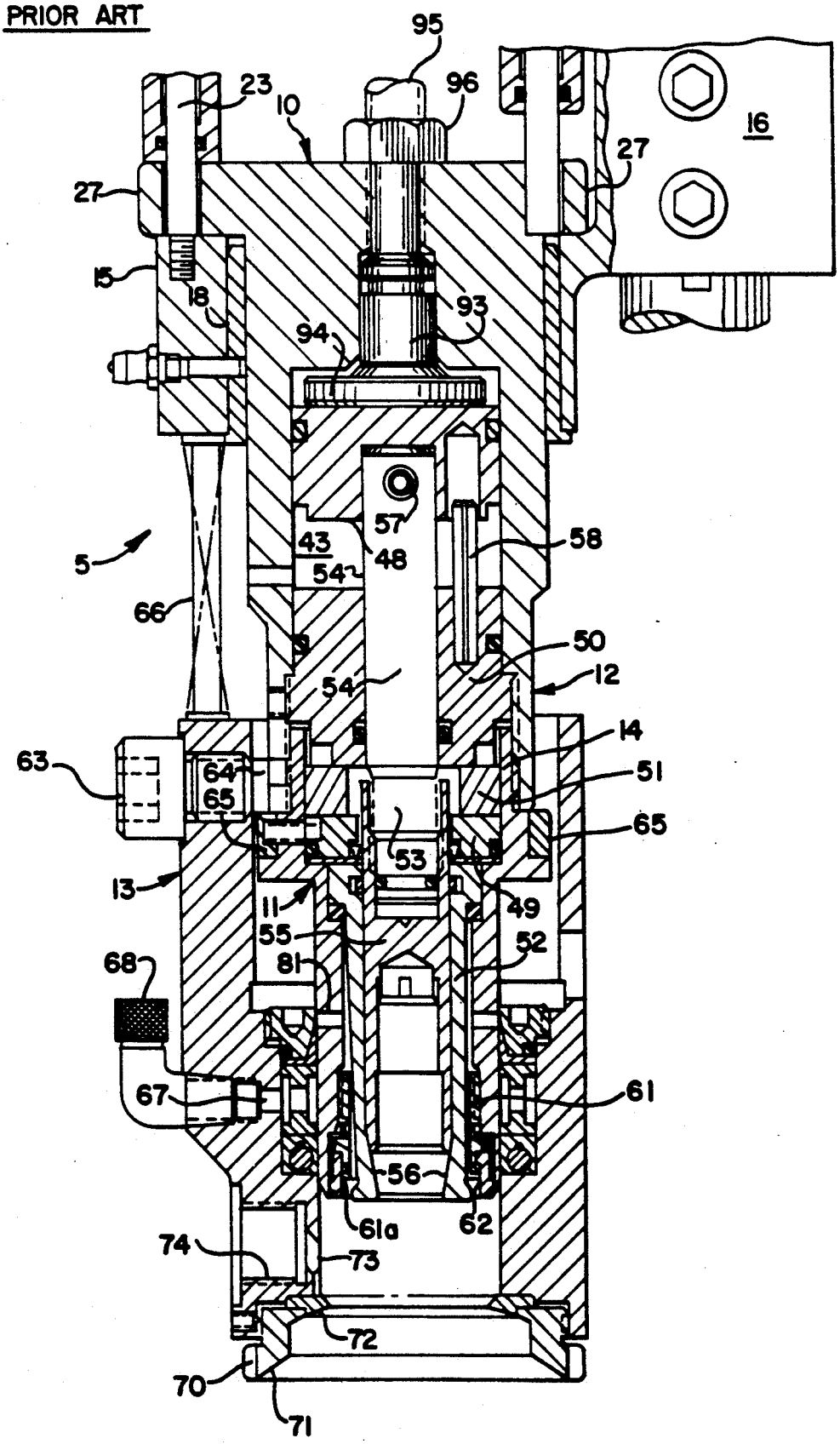
FIG. 1B PRIOR ART
Figure 2:
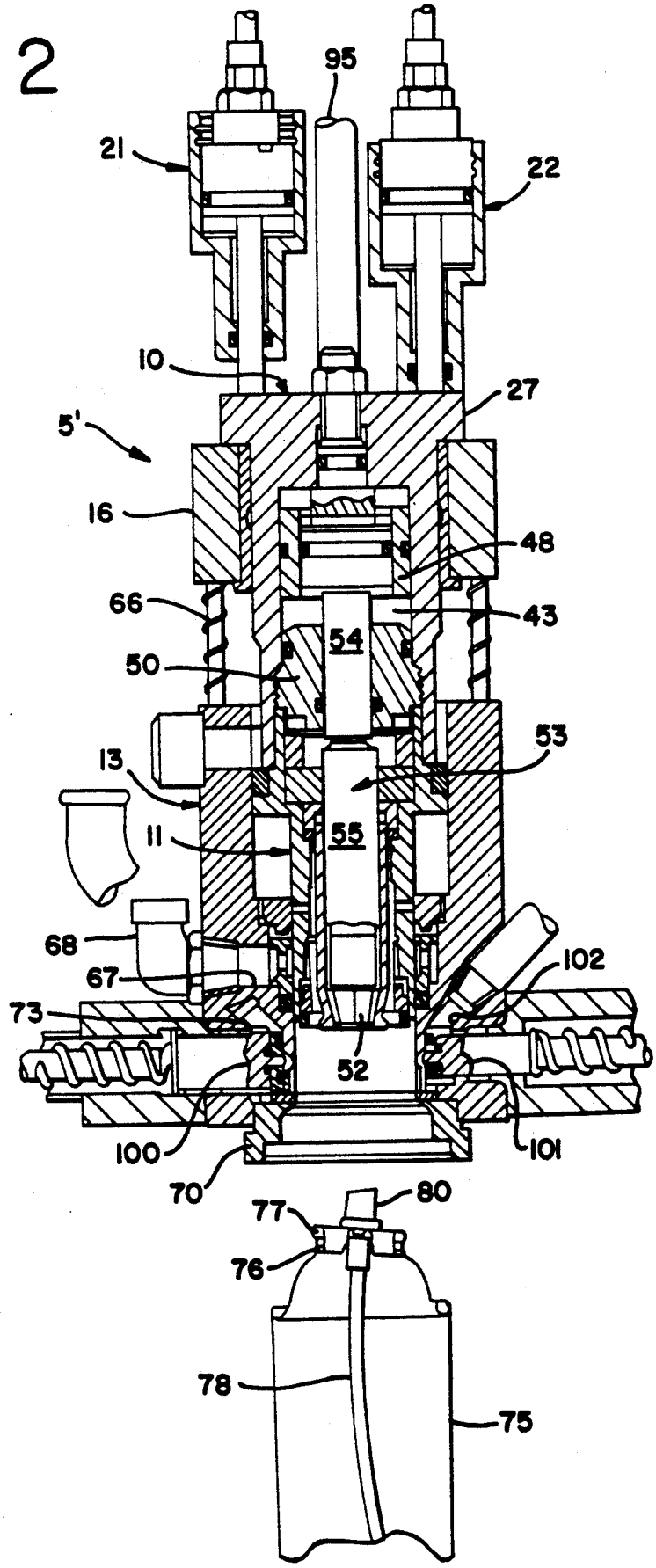
Figure 3:
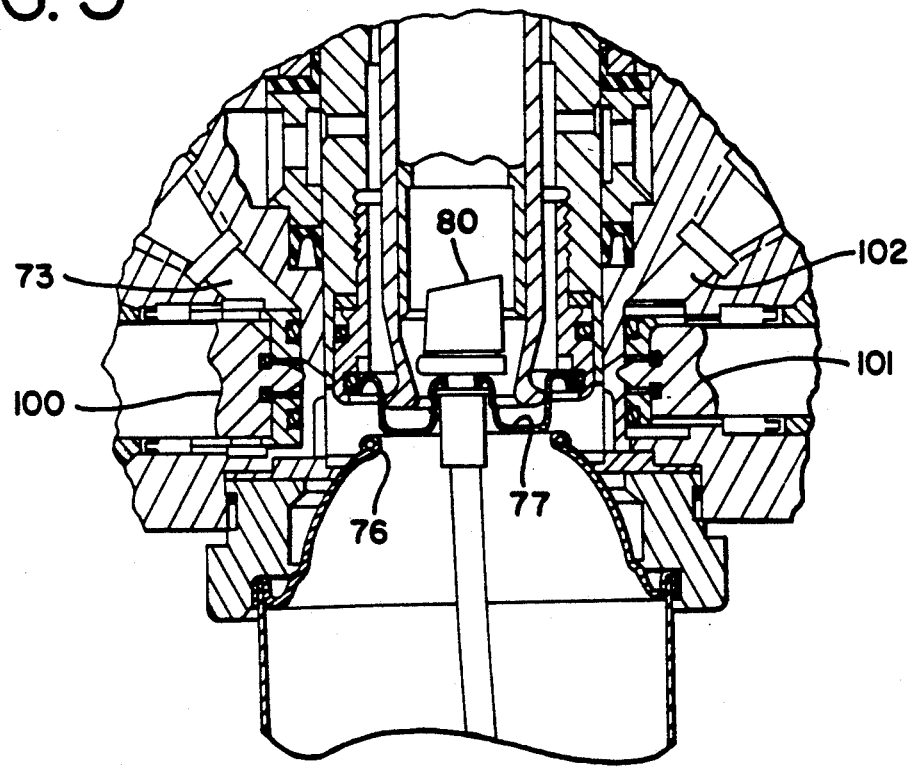
Figure 4:
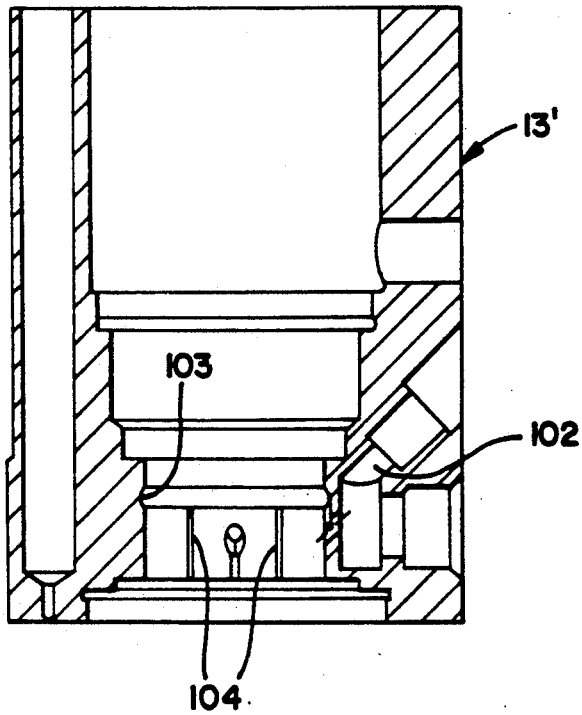

For a more complete understanding of the nature and scope of the invention, reference may now be had to the following detailed description of an illustrative embodiment of the invention taken in conjunction with the accompanying drawings, wherein:

FIGS. 1A and 1B correspond to FIGS. 1A and 1B of above-mentioned patent prior art, U.S. Pat. No. 4,938,000 and taken together comprise a vertical sectional view, with certain parts shown in elevation, of the crimper-propellant fill head shown and described in that patent;

FIG. 2 is a vertical sectional view of a crimper-propellant fill head corresponding to the crimper-propellant fill head of FIGS. 1A and 1B modified in accordance with the present invention and showing an aerosol container underneath the head;

FIG. 3 is an enlarged fragmentary sectional view showing a portion of the crimper-propellant fill head of FIG. 2 sealed onto the aerosol container and showing the relative positions of parts of the head during propellant purging according to the present invention; and FIG. 4 is a vertical sectional view of the outer bell forming one component of the crimper-propellent fill head of FIG. 2 modified to incorporate a feature of the present invention.

For a description of the operation of a prior art crimper-propellant fill head wherein residual liquid propellant was not purged and partially recovered, reference may first be had to FIGS. 1A and 1B and the operation of the crimper-propellant fill head indicated generally at 5 therein. For additional details as to the construction and operation of the head 5 reference may be had to U.S. Pat. No. 4,938,000 the disclosure of which is incorporated by reference herein.

When the head 5 is suspended from the support sleeve 16 and no container or can is located beneath the head, the parts of the head will occupy the relative positions shown in FIGS. 1A and 1B. A container to be filled with pressurized propellant will be automatically delivered and accurately positioned underneath the head 5. Such a container or can is illustrated in FIG. 2 at 75. The can 75 has a rolled rim mouth 76 to which will be sealed and crimped a closure 77 which usually is preassembled with a dip tube 78 and spray nozzle valve 80. The interior of the closure cap rim is lined with a sealant gasket of known type. When the container 75 is delivered to the crimper head 5, the closure 77 and its assembled parts will normally be loosely resting in place on the mouth 76.

A cam operated and controlled support post 17 will be actuated so as to lower the crimper head 5 whereupon the bottom adapter 70 on the outer bell 13 of the head 5 engages the top of the container 75 and the gasket 72 forms a seal with the container around the outside of the rim or closure mouth 76 thereby isolating the container mouth and closure cap assembly from the atmosphere. As the head 5 is lowered further, the upper cylinder head 10 and lower cylinder 11, and the component parts carried thereby, will be lowered while the bell 13 remains stationary. This lowering movement continues until the lateral passageway 81 (FIG. 1B) in the lower cylinder 11 comes into registry with the vacuum port 67 and into communication with the vacuum fitting 68 whereupon vacuum will be applied to the bottom interior of the bell 13 and to the container 75. The vacuum will lift the closure 77 and its assembled parts from the mouth 76 of the container 75 so that any residual air within the container 75 and within the lower portion of the bell 13 will be removed. The parts will remain in this relationship until the vacuum step is complete whereupon the post 17 is further lowered. In its fully lowered position, the stop surface of the stop sleeve 61 will rest on the top surface of the closure 77 which in turn will rest on the container mouth 76. At this point in the cycle of operation, propellant in the liquified state (e.g. liquified isobutane) is introduced under pressure into the lower end of the bell 13 through the passageway 73 and port connection 74. The resultant pressure build-up in the lower end of the bell 13 will cause the closure 77 and the lower cylinder 11 and the upper cylinder head 10 and all of the parts secured thereto to rise while the bell 13 remains stationary by reason of the downward force exerted thereon by the compression springs indicated diagrammatically at 66. Since the pistons 25 and 26 (FIG. 1A) are held stationary, the cylinder head 10 will rise until it engages bottom end of the sleeves 30. It will be seen lifting of the cylinders 21 and their sleeves 28 is resisted by the downward thrust of the pressure within these cylinders. By selecting the desired pressure, the overall resistance to lifting of cylinder 10 and associated parts can be suitably regulated or controlled. This enables the machine operator to set the crimper-propellant fill head to provide enough downward force to reliably establish the cap seal prior to introduction of propellant and also provide the desired freedom of lift without resorting to compression spring opposition during filling.

When the introduction of pressurized liquified propellant has ceased, pressure will still be trapped in the bottom of the bell 13 and in the headspace of the container 75 with the cylinder head 10 and cylinder units 21 being lifted. At this point in the operating cycle, the machine operates to lift the container a small distance (e.g. 3/16 to 7/16 of an inch) thereby raising the cylinders 22 a corresponding distance depending into which of the grooves 39*a* and 39*b* the snap rings 29 are inserted. Prior to this lifting of the container and corresponding raising of the cylinders 22, downward movement of the cylinders 22 has been prevented by the engagement of the snap rings 29 against the pistons 26. The combined downward forces exerted by pressure in the cylinders 21 and 22 will suffice to force the upper cylinder head 10 and parts assembled thereto downward until their movement is arrested by seating contact of the closure 77 with the container mouth 76. During this downward movement, the parts assembled to the cylinder head 10 and to the lower cylinder 11 are lowered. In this condition, the closure cap 77 is seated on the container mouth 76 and the lower ends 56 of the segments of collet 52 engage the closure cap 77 inwardly of its outer downwardly curved annular rim. The bottom end 61A of stop sleeve 61 will be engaged with the top of the closure cap and seal ring 62 will engage the outer periphery of the closure cap. Hydraulic fluid under pressure is now admitted into the space 43 in the upper cylinder head whereby the hydraulic fluid under pressure is applied to the top surface of the piston 48. The piston and the collet actuating plunger 53 are forced downwardly causing the bottom ends 56 of the collet segments to spread apart and thereby hermetically crimp the closure 77 to the mouth 76 of the container 75. When the crimping action has been completed, the hydraulic fluid that has entered above the piston 48 will be vented while hydraulic fluid under high pressure is admitted into the space 43 between the underside of the piston 48 and the top of the plug cap 50. As the piston 48 is forced upwardly, hydraulic fluid above the piston 48 will be expelled.

In actual practice, the cycle of operations described above with respect to the crimping-propellant fill head 5 will be carried out in about 2 seconds once the bell 13 of the head 5 has been seated on the can or container 75.

Referring to FIGS. 2–4, there is indicated generally at 5' in FIG. 2 a crimper-propellant fill head which corresponds to fill head 5 of FIGS. 1A and B but with an additional feature to be referred to. In FIG. 2, the parts or components of the head 5' which correspond to the components and parts of head 5 are given the same reference numerals. In association with the propellant inlet port 73, a propellant fill and shut-off valve 100 is provided. This valve is of known type and spring-actuated so as to open and close communication between the propellant inlet port 73 and its source of pressurized propellant and the interior of the lower bell 13. The head 5' is also shown to be equipped with a propellant purge valve 101 disposed in another valve port angularly displaced in the outer bell 13 from the valve port 74. The valve 101 functions to open and close a pressurized purge gas inlet 102 leading into the lower portion of the bell 13. It will be seen that the purge gas valve 101 and the inlet port 102 controlled thereby can also be operated as a reclaim valve by which propellant residual in the lower portion of the bell 13 can be removed and reclaimed.

The operation of crimper-propellant fill head 5' corresponds to the operation of head 5 in FIG. 1 as set forth above with one important difference and additional step. At the end of the propellant fill step in the cycle of operation upon the closure of valve 100 and propellant inlet port 73, the purge gas inlet valve 101 is opened so as to allow purge gas to be introduced through the inlet port 102. As explained above, the introduction of the purge gas serves to purge a substantial portion of the propellant residual in the lower portion of the bell 13 into the container 75 before crimping and before the head 5' is raised or lifted off of the container 75. The remainder of the propellant gas residual after purging is substantially less, and only a fraction of the residual propellant gas originally present.

It has been found that the efficiency of the purging action can be substantially enhanced by modifying the bell 13 of the head 5' so as to incorporate the feature shown in the bell indicated generally at 13' in FIG. 4. According to this modification, a circumferential groove 103 is formed in the interior surface of the bell 13' at the level at which the purge gas inlet port 102 enters the interior of the bell. A series of vertical or axial grooves 104—104 communicate with the lower portion of the circumferential groove 103 and extend downwardly to the bottom of the interior of the bell 13'. It has been found that the provision of the groove 103 together with the vertical grooves 104 substantially improves the efficiency of the introduction of the purge gas in that the groove 103 and groove 104 provide multiple paths for the purge gas whereby the purge gas is introduced faster and distributed more evenly.

It will be understood that the purge gas inlet port 102 will be suitably connected to a source of purge gas maintained under pressure within a suitable range. Two purge gases that have been satisfactorily used are nitrogen and carbon dioxide. A suitable range of purge gas pressure is between about 60 psig–100 psig. Nitrogen has the advantage as a purge gas that it does not become absorbed into the product within the container whereas carbon dioxide is absorbed into many products. However, nitrogen purge gas has the disadvantage that since it is not absorbed into the products in the containers, it remains in the head space and tends to increase the final pressure within the containers. Since carbon dioxide tends to be absorbed, it has the advantage of lower final internal can or container pressures and less pressure drop-off effect. However, the absorption of the carbon dioxide into a product alters the composition of a product and this may or may not be a disadvantage and may or may not have to be compensated for.

In practice, purge times have been used which are as short as 0.1 second and as long as approximately 1 second. Medium purge times of 0.2 second have been used. The distance that the closure cap or cup is lifted from the mouth of the container during purging is a factor to be considered and may range between 0.1–0.2 inch. In general, the longer the purge time and/or the greater the cap lift, the greater will be the amount of purge gas introduced. However, there is a limit on the amount of purge gas introduced since purge gas will cease to flow when the pressure in the bell equals the pressure of the purge gas supply.

There are two effects which temperature variations have on the purging process. The first involves the propellant temperature versus the product temperature and the second involves the compressed purge gas temperature versus the product temperature. As the liquid propellant enters the container during the metered fill, it will be either heated or cooled, approaching the temperature of the product in the container. This temperature change affects the propellant vapor pressure according to the propellant's vapor pressure-versus-temperature curve. If the propellant is at a significantly higher temperature than the product, the vapor pressure of the propellant in the container will be lower than that of the residual propellant trapped in the head. This can cause the trapped residual propellant in the head to boil off and condense into the cooler can.

The compressed purge gas experiences a similar effect as its temperature changes. The compressed purge gas will flow into the head and container only until it reaches the same pressure in the head as that in the purge gas supply tank. If the product in the container is hot, the vapor pressure of the propellant will be higher and the pressure of the compressed purge gas as it enters the head will also rise. These two conditions will cause the pressure in the head to rise to equilibrium in a very short time and with a small quantity of purge gas. Thus, the purge may be too short and the amount of purge gas too small to effectively force the residual liquid propellant into the container. Conversely, if the product is cold, the vapor pressure will be low and the pressure of the purge gas will decrease as it enters the head. Therefore, it will take a longer time for the pressure in the head to reach equilibrium and a longer purge is more effective than a shorter one.

The inter-related factors involved in the purging step or process may be summarized as follows:

1. Duration of purge; longer is more effective.
2. Purge gas tank pressure; higher is more effective.
3. Cap or cup lift; relatively low is more consistent.
4. Outer bell design; a bell with special grooves is more effective.
5. Purge gas; carbon dioxide gives a more consistent pressure than nitrogen over the life of the aerosol, but may affect product formulation.
6. Product/Propellant temperature; best results are achieved when the product is significantly cooler than the propellant.

The best method to reduce propellant loss will be a combination of the above factors which best suit each specific application.

As above-mentioned, it has been found that under certain conditions, a substantial self-purging action of the residual liquid propellant can be achieved by relying upon the rapid volatilization of the residual liquid propellant itself after the propellant fill has been completed. This procedure has been found to be effective when the residual liquid propellant is relatively warm (e.g. 70° F.) and the product in the container or can is relatively cold (e.g.50° F.). The disadvantage of this method is that the loss space within the lower bell will remain full of the propellant vapor unless a reclamation system is utilized. However, even if this residual propellant vapor is not reclaimed, its loss is significantly preferable to the additional loss of liquid propellant which can be salvaged in this self-purging method.

What is claimed:

1. In the undercap method of introducing propellant into an aerosol container containing a product to be dispensed by propellant pressure in spray or aerosol form through the external valve assembled to the closure cap sealed to the container, wherein, a bell is brought into temporary hermetic sealing relationship with the container so as to form a sealed bell chamber over the mouth of the container and including the closure cap resting on the container mouth and the external valve assembled thereto, a charge of propellant in the liquid state is introduced into the bell chamber and flows under the closure cap into the container leaving a residual amount of propellant in the sealed bell chamber, the closure cap is crimped in sealed relationship onto the container leaving said residual amount of propellant trapped in the bell chamber, and the bell and container are separated, the improvement which comprises, injecting compressed gas into said sealed bell chamber after said charge of propellant has been introduced thereby purging a substantial portion of said residual amount of propellant from said sealed bell chamber and into said container.

2. The improvement of claim 1 wherein said propellant is a hydrocarbon.

3. The improvement of claim 1 wherein said purge gas is nitrogen.

4. The improvement of claim 1 wherein said purge gas is carbon dioxide.

5. In the undercap method of introducing propellant into an aerosol container containing a product to be dispensed by propellant pressure in spray or aerosol form through the external valve assembled to the closure cap sealed to the container, wherein, a bell is brought into temporary hermetic sealing relationship with the container so as to form a sealed bell chamber over the mouth of the container and including the closure cap resting on the container mouth and the external valve assembled thereto, a charge of propellant in the liquid state is introduced into the bell chamber and flows under the closure cap into the container leaving a residual amount of propellant in the sealed bell chamber, the closure cap is crimped in sealed relationship onto the container leaving said residual amount of propellant trapped in the bell chamber, and the bell and container are separated, the improvement which comprises, maintaining a substantial temperature differential between the temperatures of the product in the aerosol container and the liquid propellant and allowing a portion of said residual amount to volatilize and purge a substantial portion of the non-volatilized residual propellant into said aerosol container.

6. The improvement of claim 5 wherein said propellant is a hydrocarbon.

* * * * *